United States Patent [19]

Mouchi

[11] Patent Number: 4,676,567

[45] Date of Patent: Jun. 30, 1987

[54] TRACK LIGHTING APPARATUS

[76] Inventor: Daniel E. Mouchi, 4724 Park Granada, Apt. 218, Calabasas, Calif. 91302

[21] Appl. No.: 818,724

[22] Filed: Jan. 14, 1986

[51] Int. Cl.[4] ..... H01R 9/00; H01R 13/60

[52] U.S. Cl. ..... 439/207; 439/116

[58] Field of Search ..... 339/20, 21 R, 21 S, 339/22 R, 22 B, 22 T, 23, 24

[56] References Cited

U.S. PATENT DOCUMENTS

| | | | |
|---|---|---|---|
| 3,757,063 | 9/1973 | Hart et al. | 339/22 B |
| 3,795,886 | 3/1974 | Hart | 339/21 R |
| 3,848,715 | 11/1974 | Hesse | 339/21 R |
| 3,933,403 | 1/1976 | Rubesamen et al. | 339/22 R |
| 4,190,309 | 2/1980 | Glass | 339/21 R |
| 4,211,460 | 7/1980 | Seelbach et al. | 339/22 B |

FOREIGN PATENT DOCUMENTS

| | | | |
|---|---|---|---|
| 1173549 | 12/1969 | United Kingdom | 339/22 T |

*Primary Examiner*—Gil Weidenfeld
*Assistant Examiner*—Gary F. Paumen
*Attorney, Agent, or Firm*—Frederick Gotha

[57] ABSTRACT

An improved track lighting apparatus wherein an electrical connecting device connects a circuit element to an electrical power track. The track carries a plurality of electrical conductors axially extending along the rail like structure of the track. There is a continuous opening which extends axially in the outer wall of the track defining a slot with laterally spaced walls which contain a channel extending axially along the length of the track. The electrical connecting device is insertable into the slot at a preselected position along the track. The connecting device has a housing made of an insulative material and carries first and second electrical contact members which are biased by a spring made of a non-conductive material. The housing carries a flange which is adapted for insertion into the track channel to form a releaseable lock. Upon rotation of the housing the electrical contact members engage the electrical conductors carried by the track and the flange member locks into the channel; a first contact member is adjustable to a preselected position so that electrical connection may be made with a preselected track rail conductor thereby providing for a selection of different electrical circuits to which to connect the circuit element.

7 Claims, 4 Drawing Figures

TRACK LIGHTING APPARATUS

BACKGROUND

This invention relates to an improved electrical connector device of the type used in track lighting systems. The electrical connector is insertable in a continuous slot in the outer wall of an electrical power track. The track carries a plurality of electrical conductors which are engaged by contact members or electrical terminals positioned on the electrical connector. The contact members are biased by a spring force to remain in contact with the electrical conductors. The contact member may be adjusted to a preselected position to make selective contact with an electrical conductor thus accommodating the selection of a distinct electrical circuit to which the circuit element carried by the electrical connector may be connected. By rotation of the housing of the electrical connector after insertion into the slot opening the rail track, a flange member carried by the housing locks into a support channel located on the track.

In track lighting systems, electrical connecting devices having terminals which connect electically to conductors carried by a supporting track is commonly known. Likewise, it is common for the connecting device to be inserted into the track through a longitudinal slot therein and thereafter rotated into a position where the electrical contact members make contact with the conductors located in the track wall. For example, U.S. Pat. No. 4,218,108 issued Aug. 19, 1980, shows a plurality of contact members which engage the electrical conductors carried by the track upon rotation of an adapter mechanism or connecting device inserted into a slot opening in the track. Additionally, the aforementioned patent discloses a plurality of flange like members which bear upon and are supported by axially extending shoulders carried in the track structure. The weight of the adapter and the circuit element are supported not only by the flange like members but also by the connecting terminals which engage the electrical conductors carried in the track wall. Typically, the electrical contact members or terminals are rigidly mounted to the housing of the connecting device to provide the additional structural support necessary to carry the weight of the connecting device and the circuit element attached to it.

One of the problems therefore in the present state of the art is that inherent tolerance variations in the extruded track results in slight misalignments between the location of the electrical conductors in the track wall and the contact members of the connecting device. Because of the rigidity of the electrical contact members, the contact members slip out of contact with the electrical conductors during the rotational engagement of the connecting members with the electrical conductors. Additionally, after the connecting device has been rotated and positioned in the track, the contact members are under stress resulting from the static weight of the connecting device and the circuit element carried by it which introduces a further propensity to slip out of electrical contact.

The rigid mounting of the contact members further causes excessive wear to occur in the contact member itself and the electrical conductors located in the track, thus frequent replacement of both contact members and electrical conductors is necessary.

Another problem exists in the prior art which is illustrated in U.S. Pat. No. 4,218,101. Because the flange members which support the adapter by bearing upon the support shoulders contained in the cavity of the track rail do not afford a positive locking means to retain the adapter within the track, the adapter conection to the track has a degree of inherent instability which further limits the static weight to be suspended from the adapter device.

SUMMARY OF THE INVENTION

It is an object of this invention to provide an improved electrical connector device for use in combination with an electrical power track where the connector housing carries a first and second contact member which are electrically conductive. The contact members are biased by a spring element to maintain resilient contact with electrical conductors carried by an electrical power track. One of the contact members is adjustable so that it may contact a plurality of conductors in the electrical power track thereby connnecting a circuit element carried by the electrical connector to a preselected electrical circuit. This adjustment is accomplished by the contact member being in slideable contact with a spring element made of a nonconductive material. The spring element contains a horizonal trough which acts as a seat for a horizonal V shaped lobe formed on the contact member. Upon engagement of the trough by the V shaped lobe, the contact member is restricted from further movement relative to the spring. The spring may contain a plurality of troughs where each trough is so dimensioned and positioned from the other such that the contact member will engage corresponding electrical conductor carried by the track as the V shaped lobe reseats in any one of the plurality of troughs contained on the spring.

It is a further object of this invention to provide an electrical connecting device which enhances the stability and retention of the connecting device after it is inserted into the supporting electrical power track. The electrical connector housing is constructed such that opposing support flange members extend radially from the housing and upon rotation of the housing within the electrical power track these flanges become captively held in axially extending channels located in the track wall. These flange members support the static weight of the electrical connector device and the circuit element attached to the connector. Thus, the strain on the contact members is relieved, the stability of the connection to the track rail enhanced, and circuit elements having heavier weight may be supported by the track, for example, a television camera.

In accordance with the invention, the use of a nonconductive spring element to bias the connection of contact members with the electrical conductors carried by the track results in a resilient connection. Excessive wear of the contact members and the electrical conductors carried by the track is thereby substantially reduced, and the tendency of the contact member to slip from engagement with an electrical conductor as a result of the difficulty to maintain extrusion tolerances of the track and the rigid structure of the contact members is reduced. Also, the electrical connector device is provided with a housing which has a longitudinal axis from which two flange support members extend radially. These flange support members in combination with axially extending channels located in lateral walls which define an axially extending slot opening in the electrical power track form a releasable lock when the connector device is inserted in the track slot and thereafter rotated. The support flanges further provide for stable retention of the connector device in the track and permit the track to support circuit elements having greater static weight.

Other details and particulars of the invention will follow from the description below and by reference to the attached drawings.

DETAILED DESCRIPTION

Figure 1:
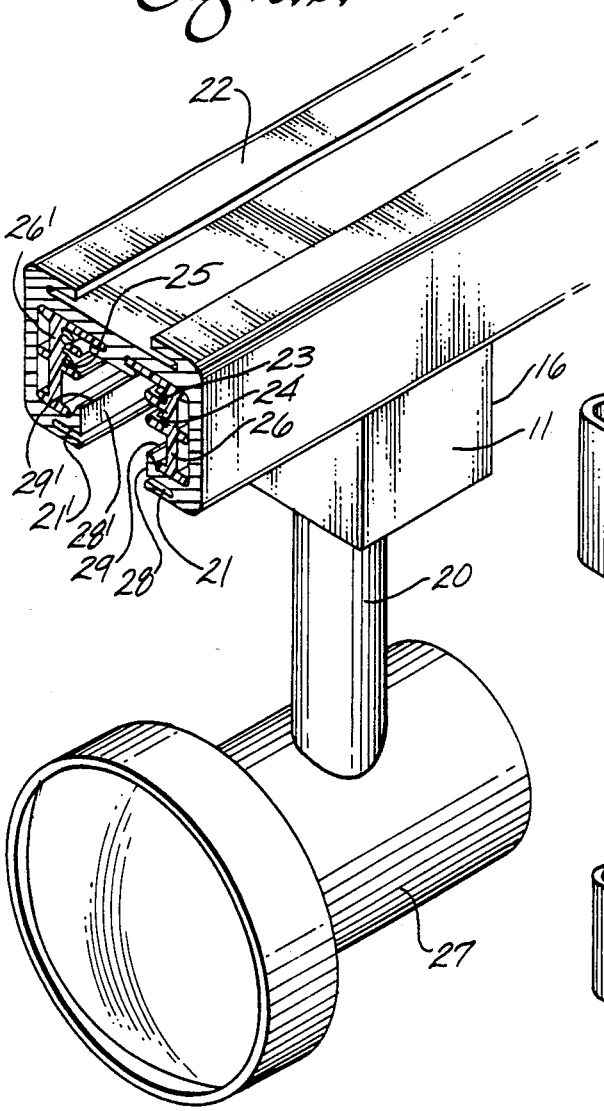
FIG. 1 is a perspective view of the electrical power track supporting the connecting device and circuit element where a crosss-sectional view is shown of the track.

Referring now to the drawings, FIG. 1 depicts an assembly of the electrical power track 22 with the electrical connecting device 1. A metal stem 20, made of a nonconductive material, acts as a conduit to provide electrical leads to the circuit element 27, which in FIG. 1 is illustrated to be a light fixture; however, the circuit element may be any type of power consuming load, such as for example a television camera, slide projector, or audio speaker. The track frame 22 is an extrusion and may be made of a conductive metal material. Insulative members 26 and 26′ are structurally supported by the track 22, and extend along the axis of elongation in the cavity of said track for its entire length. Insulators 26 and 26′ carry electrical conductors 23, 24 and 25, which also extend axially throughout the entire length of the track.

Figure 3:
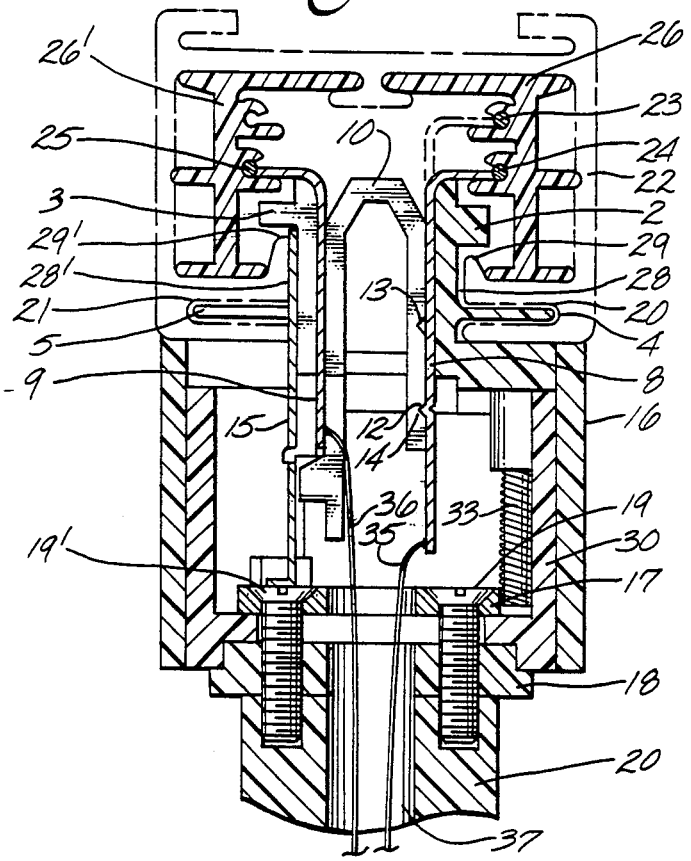
FIG. 3 is a sectional view of the electrical connector inserted in the track where the outline of the track is shown in partial phantom lines.

To accomodate the insertion of the electrical connector 11 into the track 22, the track 22 is provided with a longitudinal opening defined by lateral walls 28 and 28′, where said lateral walls terminate in support shoulders 29 and 29′. As more clearly depicted in FIG. 3, it can be seen that support shoulders 29 and 29′ have respective termini at unequal vertical heights. This difference in vertical height is necessary in order to assure that alignment members 2 and 3, which extend radially from the longitudinal axis of the connector housing 1 are properly positioned in order to support the static weight of the connector device 11 and the circuit element 27. It can also be seen in FIG. 3 that alignment shoulders 2 and 3 have bottom faces which are of differing vertical heights along the longitudinal axis of the housing 1. As a consequence of the difference in the vertical heights of said bottom faces of alignment members 2 and 3, there is only one direction in which housing 1 may be rotated after insertion in the longitudinal opening of electrical power track 22.

Referring again to FIG. 1, the lateral walls 28 and 28′ of the track 22, contain axially extending channels 21 and 21′, which are so dimensioned as to receive a first support flange 4 extending radially from the longitudinal axis of housing 1 and to receive the second support flange 5 which also extends radially from the housing and is positioned opositely from said first support flange 4. Upon rotation of housing 1 in the track cavity in the direction permitted by alignment members 2 and 3, support flanges 4 and 5 are directed into corresponding channels 21 and 21′ thereby forming a releaseable lock whereby the electrical connector 11 is captively held by the track 22.

Figure 2:
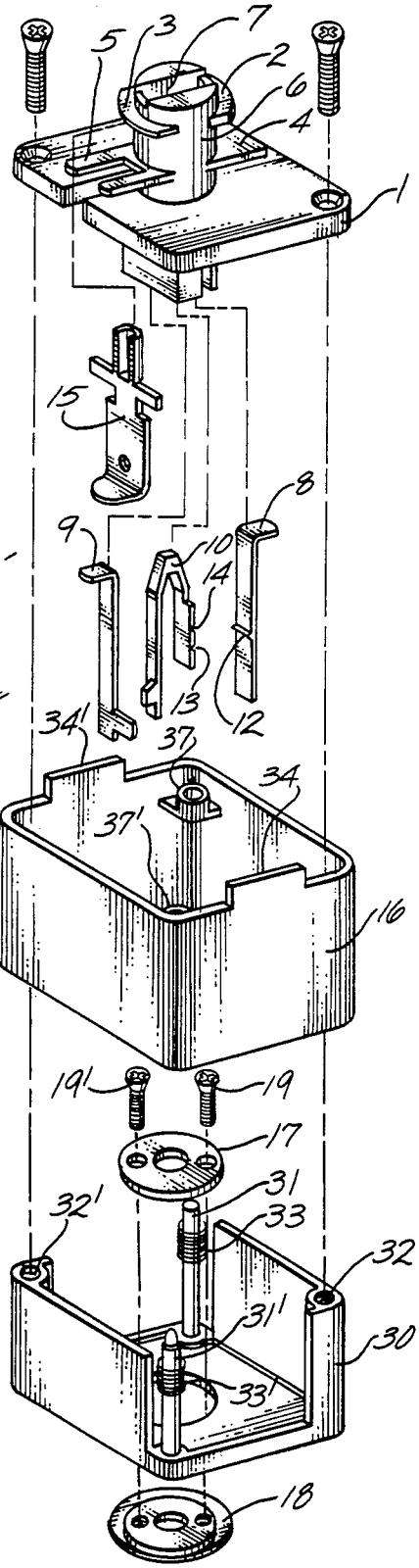
FIG. 2 is an exploded perspective view of the electrical connecting device.

The structure of electrical connector 11 is more particularly shown in FIG. 2. The housing 1 is made of a nonconductive material. Said housing incorporates a tubular member 6 which extends longitudinally along the axis of the said housing 1 where said tubular member 6 and alignment shoulders 2 and 3 are made of a nonconductive material. An electrical ground element 15 is fixed to the housing and bears upon the surface of the metal fastener 19′. Contact members 8 and 9 are made of a conductive material and extend through a longitudinal slot contained in barrel 6 of the housing 1. As is more clearly seen in FIG. 3, a spring 10, which is also made of a nonconductive material bears upon said contact members 8 and 9 applying a force to bias said contact members against electrical conductors 24 and 25. The spring 10 contains a lower V slot 13 and upper V slot 14, which may be selectively engaged by the V notch 12 carried by the first contact member 8. In one embodiment, when V notch 12 engages lower V slot 13 the first contact member 8 is positioned to engage electrical conductor 24. In another embodiment, by sliding the first contact member vertically along the spring 10, V notch 12 will engage upper V slot 14 and seat thereby forming a lock which places contact member 8 in a preselected position so as to engage electrical conductor 23. As can be seen from the drawings the second contact member 9 remains in a fixed position and is so dimensioned and positioned so that said contact member will engage electrical conductor 25 after the housing 1 has been inserted in the longitudinal opening of said track 22 and rotated in the direction permitted by alignment members 3 and 6 until said housing is locked into position by the engagement of flange members 4 and 5 with corresponding channels 21 and 21′ located in the lateral walls 28 and 28′ of said track 22.

Referring again to FIG. 2 it can be seen that the housing 1 is enclosed by a nonconducting housing sleeve 16 where the housing sleeve connects to a base member 30 having attachment fingers 31 and 31′ and threaded holes 32 and 32′. Coil springs 33 and 33′ are mounted on attachment fingers 31 and 31′ to form receptacles for guidance slots 37 and 37′ which are contained on the inner wall of housing sleeve 16. As is evident from the exploded view of FIG. 2, the assembly of the electrical connector device 11 results in the housing sleeve 16 being moveably mounted on the base 30 permitting said sleeve to be retracted toward the base 30 while the housing 1 remains in a fixed position as a result of being fastened at threaded holes 32 and 32′. The retractability of housing sleeve 16 permits insertion of the housing 1 into the track 22 such that upon rotation of said housing and engagement by support flange members 4 and 5 of respective channels 21 and 21′ said coil springs 33 and 33′ apply a force to said housing sleeve and thereby cause protuberances 34 and 34′ of said housing sleeve 16 to extend into the longitudinal opening of said track 22 thereby further preventing rotation of said housing 1 after the contact members 8 and 9 have engaged electrical conductors 23 and 24, or 23 and 25, depending upon the circuit selected for connection with circuit element 27.

Rotation of the circuit element 27 is permitted by the metal stem 20 which is connected to a nonconductive second rondelle 18 that bears upon the lower wall of the base 30. First rondelle 17 which is made of a conductive metallic material bears upon the upper face of base 30 and is connected to the second rondelle 18 by fasteners 19 and 19' which pass through first rondelle 17 and second rondelle 18 and thereafter thread into the metal stem 20. A cavity 37 in the metal stem 20 permits conducting wires 35 and 36 to pass through the metal stem and connect to correspsonding terminals on the circuit element 27. This structure pemits rotation of the circuit element 27 to any desired position.

Figure 4:
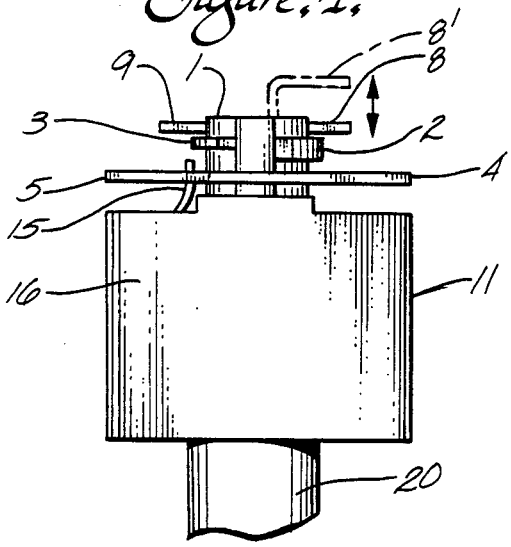
FIG. 4 is an outlined side view of the electrical connector showing the electrical contact member in a first and second position.

To describe the function of the electrical connector, attention is directed to FIG. 4 which illustrates the outline of the connector 11 and demonstrates the alternate positions which may be preselected for contact member 8; these positions are shown by the numerals 8 and 8'. After the circuit is selected to which the circuit element is to be connected, contact member 8 is moved to the appropriate preselected position. The housing assembly 11 is then inserted into the longitudinal opening of track 22; in order to accomplish this, housing 1 must be positioned such that the radial edges of flange members 4 and 5 are in a parallel position to lateral walls 28 and 28'. First alignment support member 2 and second alignment support shoulder 3 upon rotation of housing 1 guide second contact member 9 and first contact member 8 into a proper engagement position because of the geometrical relationships between said first alignment and second alignment support shoulders and the shoulder termini 29 and 29' of lateral walls 28 and 28'. Thus, the first support flange 4 and the second support flange 5 are guided into channels 21 and 21' respectively and the housing 1 is releaseably locked into an engagement position whereby contact members 8 and 9 are connected with the electrical conductors carried by the track 22. Because of the resilience of the spring 10, the contact members are biased against the electrical conductors thereby preventing excessive wear of the contact members and the electrical conductors thus prolonging the life of the electrical connector 11.

It is understood that all terms used herein are descriptive rather than limiting. While the invention has been described in conjunction with specific embodiments, it is evident that many alternatives, modifications and variations will be apparent to those skilled in the art in light of disclosure herein. Accordingly, it is intended to include all such alternatives, modifications, and variations involved in the spirit and scope of the impending claims.

I claim:

1. In combination:

an electrical power track comprising a rail like structure having an inside and outside wall, an axis of elongation, an axially extending cavity where said cavity is bounded by said inside wall and where said rail like structure has a continuous opening which extends axially in said outer wall of said rail like structure and communicates with said cavity such that said continuous opening defines a slot with laterally and oppositely spaced walls interconnecting said inside and outside walls, a plurality of axially extending electrical conductors carried by said rail like structure, an axially extending first support shoulder forming a terminus for one said lateral wall at the intersection of said lateral wall with said inner wall of said rail like structure, an axially extending second support shoulder forming a terminus for the opposite lateral wall at the intersection of said opposite lateral wall with said inner wall of said rail like structure where said laterally and oppositely spaced walls respectively contain an axially extending channel spaced intermediate said inner wall and said outer wall; and, an electrical connector device comprising a housing made of an insulative material having a longitudinal axis and so dimensioned to be selectively insertible in said axially extending slot and rotatable therein about said longitudinal axis, a housing sleeve slideably mounted on said housing and having a protuberance so dimensioned and proportioned to preclude rotation of said housing when said protuberance extends into said slot, a spring means carried by said housing and bearing upon said housing sleeve for applying a restoring force to said housing sleeve upon axial displacement thereof relative to the longitudinal axis of said housing, a first electrical contact member carried by said housing and slideably mounted thereon, a second electrical contact member carried by said housing where said first and second electrical contact members are laterally spaced from said longitudinal axis and each said member adapted for respective engagement with one of said plurality of electrical conductors, a means made of a nonconductive material carried by said housing and bearing upon said first and second contact members for applying a bias force to said first and second contact members, a first alignment member carried by said housing extending radially from the longitudinal axis of said housing, a second alignment member extending radially from the longitudinal axis of said housing and positioned oppositely from the said first alignment member and said housing sleeve is axially displaced away from said track upon insertion of said housing in said slot thereby aligning said first and second alignment members for engagement with said first and second support shoulders respectively and thereafter upon sufficient rotation of said housing said protuberance is rotated into alignment with said slot thereby permitting said sleeve to be displaced responsive to said restoring force and said protuberance extends into said slot thereby releaseably locking said housing in said slot and aligning said first and second contact members for electrical engagement with a respective electrical conductor of said track.

2. The combination according to claim 1 where said electrical connector device further comprises a flange member radially extending from said housing and so positioned and dimensioned so that upon insertion and rotation of said housing said flange is captively held in the channel of said track.

3. The combination according to claim 1 where said electrical connecting device further comprises a releaseable locking means associated with said first electrical contact member and said bias means for releaseably locking said first electrical contact member in a preselected position along the longitudinal axis of said housing.

4. A lock for securing the position of an electrical connector along an electrical power track, said track having an axis of elongation and an axially extending cavity with an opening on an outer wall of said track communicating with said cavity defining an axially extending slot where a wall of said slot contains an axially extending channel, said electrical connector comprising a housing having a longitudinal axis and an axially extending attachment finger laterally spaced from said lonitudinal axis, a housing sleeve slideably mounted on said housing and having a guidance slot for accepting said attachment finger so as to permit relative axial movement between said housing and said sleeve, said housing sleeve having a protuberance so dimensioned and proportioned to preclude rotation of said housing when said protuberance extends into said axially extending slot, a spring means carried by said attachment finger and bearing upon said housing sleeve for applying a restoring force to said housing sleeve upon axial displacement thereof relative to the longitudinal axis of said housing, a flange means extending radially from the longitudinal axis of said housing for insertion in said channel upon rotation of said housing, and said housing sleeve is axially displaced upon insertion of said housing in said slot thereby permitting alignment of said flange means with said channel and upon sufficient rotation of said housing said protuberance responsive to said restoring force extends into said axially extending slot and thereby said flange means is releaseably held in said axially extending channel at a preselected position along said track and said housing is releaseably locked in said axially extending slot.

5. An electrical connecting device for connecting a circuit element to an electrical power track comprising:

(a) a housing made of an insulative material and having a longitudinal axis, said housing comprising a housing sleeve slideably mounted on said housing and having a protuberance so dimensioned and proportioned to preclude rotation of said housing when said protuberance extends into said electrical power track, a spring means carried by said housing and bearing upon said housing sleeve for applying a restoring force to said housing sleeve upon axial displacement thereof rleative to the longitudinal axis of said housing;

(b) a first electrical contact member carried by said housing and slideably mounted thereon;

(c) a second electrical contact member carried by said housing and laterally spaced from said first electrical contact member;

(d) a bias means made of a nonconductive material carried by said housing bearing upon said first and second contact members for applying a bias force to said first and second contact members;

(e) a pair of alignment members oppositely spaced and extending radially from said housing and axially positioned below said first and second electrical contact members.

6. The electrical connecting device of claim 5 further comprising a locking means associated with said first electrical contact member and with said bias means for locking said first electrical contact member in a preselected axial position.

7. The electrical connecting device of claim 5 further comprising a pair of support flange members carried by said housing and extending radially therefrom where said flange members are spaced below said alignment members and so dimensioned and adapted to be releaseably held by said track.

* * * * *